United States Patent [19]

Uydess

[11] Patent Number: 4,651,759

[45] Date of Patent: Mar. 24, 1987

[54] START-UP PROCESS FOR THE THERMOPHILIC DENITRIFICATION OF TOBACCO

[75] Inventor: Ian L. Uydess, Midlothian, Va.

[73] Assignee: Philip Morris Incorporated, New York, N.Y.

[21] Appl. No.: 484,384

[22] Filed: Apr. 12, 1983

[51] Int. Cl.[4] ..... A24B 3/14; A24B 15/02

[52] U.S. Cl. ..... 131/297; 131/308; 131/356; 435/267; 210/603; 210/605; 210/622; 210/903

[58] Field of Search ..... 131/290, 297, 308, 356, 131/370; 210/601, 603, 605, 622, 905, 612; 435/172, 262, 267

[56] References Cited

U.S. PATENT DOCUMENTS

| | | |
|---|---|---|
| 2,000,855 | 5/1935 | Lippmann et al. . |
| 2,317,792 | 4/1943 | Moser . |
| 3,747,608 | 7/1973 | Gravely et al. . |
| 4,037,609 | 7/1977 | Newton et al. . |
| 4,308,877 | 1/1982 | Mattina . |
| 4,566,469 | 1/1986 | Semp et al. . |
| 4,622,982 | 11/1986 | Helmut et al. . |

FOREIGN PATENT DOCUMENTS

| | | |
|---|---|---|
| 1081076 | 7/1980 | Canada . |
| 0005082 | 10/1979 | European Pat. Off. . |
| P3100715.5 | 7/1982 | Fed. Rep. of Germany . |
| 48-49999 | 7/1973 | Japan . |
| 2014031 | 8/1979 | United Kingdom . |
| 1557253 | 12/1979 | United Kingdom . |
| 2023995 | 1/1980 | United Kingdom . |
| 2028628 | 3/1980 | United Kingdom . |
| 1585023 | 2/1981 | United Kingdom . |
| 1585024 | 2/1981 | United Kingdom . |

OTHER PUBLICATIONS

W. O. Atkinson et al., *Ky. Arg. Exp. Sta. Lexington Ann. Report,* 86, p. 22 (1973).

B. Dumery and J. P. Albo, "Participation of Microorganisms in the Fermentation of Dark Tobacco Submitted to a 'Pre-Storage Thermic Treatment Storage' Type of Process", *A. du Tabac,* Sect. 2-16, Bergerac, S.E.I.T.A. (1979-1980).

C. F. English et al., "Isolation of Thermophiles from Broadleaf Tobacco and Effect of Pure Culture Inoculation on Cigar Aroma and Mildness", *Applied Microbiol.,* 15, pp. 117-119, (Jan. 1967).

S. A. Ghabrial, "Studies on the Microflora of Air-Cured Burley Tobacco", *Tobacco Science,* pp. 80-82 (1976).

A. Koiwai et al., "Fermentation of Tobacco, II. Variations in Fermentation Procedure and Its Effect on Total Particulate Matter and Benzo(a)pyrene" *Tobacco Science,* 15, pp. 41-43 (1971) [Chemical Abstracts, 75:44103j, p. 220 (Feb. 1972)].

P. A. Nielsen, "Physiological Properties of Nitrate-Reducing Micrococci Isolated from Tobacco Leaves", Dissertation, Columbia University (1960).

H. E. Reiling et al., "Calorimetric Studies of the Anaerobic Respiration of a Thermophilic Bacillus Species", Inst. Mol. Biol., Biophys. Swiss Fed. Inst. Technol, CH-8093, Zurich, Switzerland and J. Calorim. Anal. Therm., 11, pp. 3-14-1-3-14-18 (1980) [Chemical Abstracts, 95: 93615C, p. 298 (Sept. 1981)].

*Primary Examiner*—V. Millin
*Assistant Examiner*—Gregory Beauiage
*Attorney, Agent, or Firm*—Arthur I. Palmer, Jr.; James F. Haley, Jr.; Margaret A. Pierri

[57] ABSTRACT

Process for the start-up of high-temperature processes for the denitrification of tobacco materials via an anaerobic dissimilatory metabolic pathway of thermophilic organisms. The process advantageously permits the induction of denitrification activity through the use of a seed culture which, itself, is the product of a previous thermophilic denitrification treatment of the same type as that to which the start-up process is directed.

23 Claims, No Drawings

START-UP PROCESS FOR THE THERMOPHILIC DENITRIFICATION OF TOBACCO

TECHNICAL FIELD

This invention relates to the denitrification of tobacco materials via dissimilatory metabolism. More particularly, it relates to a process, as well as a seed culture useful in this process, for the start-up of high-temperature processes which reduce the levels of nitrates and other nitrogen-containing compounds in tobacco materials via an anaerobic dissimilatory metabolic pathway of thermophilic microorganisms.

BACKGROUND ART

It is generally recognized that reduced delivery of oxides of nitrogen in the smoke of tobacco products is desirable. Therefore, a number of methods have been developed to reduce the levels of nitrogen oxide precursors, such as nitrates, in smoking products. While some of these methods are based on ion exchange or crystallization mechanisms, others employ microbiological means for reducing the levels of certain nitrogen-containing compounds in tobacco materials.

The microbial processes and microorganisms employed may be either aerobic or anaerobic and may utilize dissimilatory or assimilatory pathways to metabolize the nitrogen-containing compounds. These processes and organisms, for example, include those of U.S. Pat. No. 3,747,608, British patent specification No. 1,557,253 (stated to be based on U.S. patent application No. 883,449, filed Mar. 6, 1978), UK patent applications No. 2,014,031A (based on Luxembourg application No. 79039, filed Feb. 9, 1978), 2,023,995A (stated to be based on U.S. patent application No. 916,323, filed June 15, 1978), Canadian Pat. No. 1,081,076 (based on Luxembourg application No. 77272, filed May 6, 1977, and Luxembourg application No. 77872, filed July 29, 1977), European patent application No. 0,005,082 (based on U.S. patent application No. 900,044, filed Apr. 25, 1978) and West German patent application No. P3100715.5, filed Jan. 13, 1981.

While some of these processes make use of bacteria that belong to the indigenous microflora of tobacco, each employs only non-thermophilic microorganisms as the active microbial agent. Each also employs only low temperature fermentation conditions—5°-40° C. For example, British patent specification No. 1,557,253 employs 5°-35° C., Canadian Pat. No. 1,081,076—25°-35° C., UK patent application No. 2,014,031A—25°-35° C., UK patent application No. 2,023,995A—20°-40° C., UK patent application No. 2,028,628A—5°-37° C., European patent application No. 0,005,082—30°-40° C., West German patent application No. P3100715.5—30° C. and U.S. Pat. No. 3,747,608—24°-40° C.

Most of these processes also require that the tobacco materials be terminally sterilized (e.g., 121° C. for 15 min at 15 psig) before contact with the microorganisms and that the fermentation be conducted under substantially aseptic conditions. The various anaerobic processes also usually require sparging of the fermentation broth with inert gases or other treatments to limit the oxygen concentration.

A number of these processes also require various additives to be incorporated into the fermentation broths or to supplement the tobacco material isolated from those broths after fermentation. For example, British patent specification No. 1,557,253 requires various organic compounds to be added to the tobacco materials, Canadian Pat. No. 1,081,076 and UK patent application No. 2,014,031A require D-glucose and other additives and West German patent application No. P3100715.5 requires that sugars be added to the broth. Plainly, any requirement for such additives increases the cost of such processes and may result in non-tobacco compounds being incorporated into the tobacco materials.

Other microbial-based processes for treating tobacco are also known in the art. For example, U.S. Pat. Nos. 2,000,855, 3,747,608 and 4,037,609 purport to describe microbial processes and microorganisms for degrading nicotine that may be present in tobacco. These processes, although again perhaps making use of bacteria that belong to the indigenous microflora of tobacco, are also non-thermophilic and employ low temperature fermentation conditions, e.g., 24°-40° C. (U.S. Pat. No. 3,747,608), 20°-45° C. (U.S. Pat. No. 4,037,609) and 30°-40° C. (U.S. Pat. No. 2,000,855).

In addition, Japanese Pat. No. 73 49,999 (C.A. 79:123942x), S. A. Ghabrial, "Studies On The Microflora Of Air-Cured Burley Tobacco", *Tobacco Science*, pp. 80-82 (1976), W. O. Atkinson et al., *Ky. Agr. Exp. Sta. Lexington Ann. Report*, 86, p. 22 (1973), A. Koiwai et al., "Fermentation of Tobacco, II. Variations In Fermentation Procedure And Its Effect On Total Particulate Matter And Benzo(a) pyrene", *Tob. Sci*, 15, pp. 41-3 (1971), and U.S. Pat. No. 2,317,792 purport to describe other microbial-based fermentation and curing processes for tobacco. Again, each of these processes employs non-thermophilic organisms and low temperature fermentation conditions, e.g., 25°-50° C. (Japanese Pat. No. 73 49,999), 30°-35° C. (S. A. Ghabrial) and 30°-40° C. (A. Koiwai et al.).

The growth of thermophilic microorganisms on "sweating" tobacco is known to occur. However, such organisms have not been employed to reduce the content of nitrogen-containing compounds in tobacco. Rather, they have only been described to affect the aroma and mildness of cigar tobacco. Such processes include, for example, those of C. F. English et al., "Isolation Of Thermophiles From Broadleaf Tobacco And Effect Of Pure Culture Inoculation On Cigar Aroma And Mildness", *Applied Microbiol.*, 15, pp. 117-19 (January 1967), and B. Dumery and J. P. Albo, "Participation of Microorganisms In The Fermentation Of Dark Tobacco Submitted To A "Pre-Storage-Thermic Treatment Storage" Type Of Process", *A du Tabac*, Sect. 2-16, Bergerac, S.E.I.T.A. (1979-80).

In U.S. patent application No. 307,602, filed Oct. 1, 1981, a process is described for the dentrification of tobacco materials by the action of thermophilic microorganisms in high temperature fermentation processes. Specifically, the levels of nitrates and other nitrogen-containing compounds present in tobacco materials are reduced via an anaerobic dissimilatory metabolic pathway of thermophilic organisms. The process advantageously permits such reduction to be effected without the need for additives to the fermentation broth or tobacco materials.

As with any microbial-based process, the start-up of microbial activity is of importance to the overall process itself. It is generally recognized by those skilled in the art of fermentation that microbial enzymatic reactions are highly sensitive to forces of a mechanical nature, as well as temperature and pH conditions. Just as these factors are critical to a given microbial denitrification process, such as that disclosed in U.S. patent application No. 307,602, they are also important in the start-up of the microbial denitrification activity. A well-defined, easily controlled start-up process contributes to optimal microbial activity in the denitrification process. Though the denitrification process may be maintained almost indefinitely once it starts, the overall efficiency and commercial success of the process is increased by predictable and reliable means of start-up. Optimal output of denitrified products is also ensured when the denitrification process can be initiated via relatively short and efficient start-up procedures, or suspended in a similarly efficient manner, when required.

DISCLOSURE OF THE INVENTION

The present invention satisfies all of these criteria. Specifically, it permits the efficient and reliable start-up of high temperature processes for the denitrification of tobacco materials via an anaerobic dissimilatory metabolic pathway of thermophilic organisms. Advantageously, it permits start-up of the denitrification process through the use of stored seed culture which, itself, is the product of a previous run of a denitrification process of the same type as that which the start-up process initiates.

As will be appreciated from the disclosure to follow, the start-up process of this invention is characterized by the step of contacting a seed culture, comprising denitrified tobacco materials which are the product of a previous thermophilic denitrification treatment, with nitrogen-containing tobacco materials.

The denitrified tobacco materials which are present in the seed culture have a nitrate-nitrogen content of about 0 ppm and a nitrite-nitrogen content of less than or equal to about 100 ppm (falling to zero after initial collection). The seed culture is used to start a lineage of serially-staged fermentors of progressively increasing size and the resulting end product is advantageously used to start-up the large, process-line fermentors of a commercial thermophilic microbial denitrification process.

The denitrified tobacco materials which comprise the seed culture contain a pure or mixed culture of thermophilic microorganisms capable of anaerobic dissimilation of nitrogen-containing compounds of tobacco under the actual fermentation conditions employed including, for example, pH, temperature, and other levels which promote such anaerobic dissimilatory metabolism. Preferably, the thermophilic microorganisms are thermophilic organisms belonging to the indigenous microflora of tobacco or selected mutations thereof.

The terms "nitrogen-containing tobacco materials" or "nitrogen-containing tobacco extract" as used herein are defined as materials or extracts containing primary or intermediate substrates in dissimilatory denitrification.

The term "thermophilic organism" as used herein is defined as an organism which grows and denitrifies at temperatures of 45° C. or higher.

DETAILED DESCRIPTION OF THE INVENTION

The present invention provides a novel method for start-up of a process for the thermophilic denitrification of tobacco materials by thermophilic microorganisms characterized by an anaerobic, dissimilatory metabolic pathway. One such thermophilic denitrification process and one such thermophilic organism or mixed culture are described in U.S. patent application No. 307,602, which is hereby incorporated by reference.

In tobacco product manufacturing, the time required for microbial denitrification of tobacco materials can operate as a limitation on production yields and rates. By providing a time-efficient and reliable method for start-up of microbial denitrification activity, the present invention increases the overall efficiency of the denitrification process, particularly when a large-scale, commercial operation is involved.

Broadly stated, the process of this invention comprises the step of contacting a seed culture with nitrogen-containing tobacco materials, whereby the level of nitrates and other nitrogen-containing compounds in those materials is effectively reduced. More specifically, the process of the invention comprises contacting a seed culture with nitrogen-containing tobacco materials and bringing the resulting mixture to a temperature which promotes anaerobic, dissimilatory denitrification of the nitrogen-containing tobacco materials. All or a portion of the resulting denitrified tobacco materials may be contacted with nitrogen-containing materials under anaerobic and high temperature conditions that promote the anaerobic, dissimilatory denitrification of the nitrogen-containing tobacco materials.

Advantageously, the seed culture comprises denitrified tobacco materials which are the product of a previous thermophilic denitrification treatment of the same type as that to which the present start-up process is directed. Thus, the denitrified tobacco materials are the product of a previous thermophilic denitrification process utilizing at least one thermophilic organism characterized by an anaerobic, dissimilatory pathway for denitrification of tobacco materials under anaerobic and high temperature conditions that promote such metabolism. The denitrified tobacco materials which comprise the seed culture contain a pure or mixed culture of thermophilic microorganisms capable of anaerobic dissimilation of nitrogen-containing compounds of tobacco.

In addition, the denitrified tobacco materials which are present in the seed culture have a nitrate-nitrogen content of about 0 ppm and a nitrate-nitrogen content of less than or equal to about 100 ppm (falling to zero after initial collection). Preferably, the thermophilic microorganisms are thermophilic organisms belonging to the indigenous microflora of tobacco or selected mutations thereof.

In the practice of the present invention, thermophilic microorganisms which, under the actual fermentation conditions employed, reduce nitrate in tobacco materials to nitrogen gas via a series of metabolic steps, commonly known as dissimilatory denitrification, are used. Nitrate reduction via this metabolic pathway is believed to be effected by a series of classical enzymatic reactions shown schematically below:

$$NO_3^- \rightarrow NO_2^- \rightarrow NO \rightarrow N_2O \rightarrow N_2 \uparrow$$

Such process is to be contrasted with assimilatory denitrification, where nitrate is converted to ammonia and protein or biomass.

For the purpose of the present invention, dissimilatory reduction is selected since nitrogen gas, the end product of the metabolic reduction of nitrate, can be completely and easily removed from the treated tobacco materials. Moreover, no other nitrogen-containing metabolites or other compounds that could potentially affect the subjective characteristics of the treated tobacco materials ultimately obtained, or influence the characteristics of tobacco products made from those tobacco materials or the smoke produced by smoking products made from those tobacco materials, are required by the process or organisms employed in this invention.

The process of this invention is advantageous because no nutrients or supplements must be added to the tobacco materials, the pH of the fermentation is maintained by the action of the microorganism culture itself, the tobacco materials are fed to the microorganism culture at substantially the same temperature as they are contacted with that culture, i.e., substantially no cooling of the fermentation broth is required and vigorous agitation of the fermentation broth is not required. Although preferred, substantially aseptic fermentation conditions or the terminal sterilization of the tobacco materials prior to contact with the microorganisms is not required because the anaerobic, high temperature conditions of the contact between the tobacco materials and the thermophilic microorganisms discourage the growth of other organisms.

It should be plainly understood that merely because a thermophilic organism may have a metabolic pathway for the dissimilatory metabolism of nitrate, it cannot be said on that basis alone to be useful in the process of this invention. This is particularly true for organisms which may in fact have such a metabolic pathway operating under some test or growth media conditions, e.g. a standard biological characterization assay. Rather, to be useful in the process of this invention, a thermophilic organism must have operative metabolic pathways that permit the dissimilatory metabolism of nitrate and other nitrogen-containing compounds in tobacco materials under the actual high temperature, anaerobic conditions described herein. A wide variety of such thermophilic organisms may be selected by screening for active denitrifiers of tobacco materials under the particular conditions of use described herein. It should be understood that only such latter organisms are utilized in this invention.

Preferably, the source of such microorganisms is tobacco itself. Microorganisms useful in the seed culture for the start-up process of this invention are those which are useful in the thermophilic denitrification process described in U.S. patent application No. 307,602 and which are present in the denitrified product thereof. Such organisms may be isolated from tobacco materials by various methods. One method employed to isolate and identify the microorganisms useful in the present process was to prepare a portion of extracted tobacco liquor using conventional procedures. The liquor was then diluted with 0.9M NaCl solution and mixed with soft agar (53° C.). The resulting mix was plated on nutrient agar medium and allowed to incubate at 55°–60° C. for 3 days. Colonies that grew well at 55°–60° C. were streaked onto nitrate broth (10 g/l $KNO_3$) agar plates and again incubated at 55°–60° C. Colonies that grew on the nitrate broth plates were characterized by their ability to denitrify tobacco materials under the actual fermentation conditions described herein. Such microorganisms are present in the denitrified tobacco materials which serve as seed culture in the process of this invention.

Alternatively, a mixed culture useful in the process of this invention was identified by mixing representative samples of extracted tobacco liquor taken, for example, from various locations in an operating reconstituted tobacco processing line. These mixtures were then analyzed for the presence of microorganisms displaying thermophilic denitrification activity by contacting extracted tobacco liquor or nitrate-containing media with the mixture. Colonies that grew in such media were then characterized on the basis of their ability to denitrify tobacco materials under the actual fermentation conditions described herein. It should also be understood that the particular organisms of the mixed culture, displaying such required activity could, of course, be identified or isolated by using the first-described method or even by merely culturing the selected mixture on tobacco extract at above 45° C., isolating the various cultures, and selecting those cultures that were active denitrifiers of tobacco materials under the fermentation conditions described herein.

A seed culture, PM-1581, useful in the start-up process of this invention has been deposited in the American Type Culture Collection, Rockville, Md. on Apr. 12, 1983, and has been assigned accession number ATCC 39333.

Microorganisms advantageously present in the seed culture of this invention and identified and isolated by one or more of the above-described methods have been deposited in the American Type Culture Collection, Rockville, Md. on Oct. 1, 1981. There, they have been assigned the following accession numbers:

Culture PM-1: ATCC 31973
Culture PM-2: ATCC 31974
Culture PM-3: ATCC 31972
Culture PM-4: ATCC 31971

Culture PM-1 has been characterized by the American Type Culture Collection as Bacillus sp. Its morphological and biochemical characteristics are set forth below.

Morphological Characterization

Cells are Gram variable, non-motile rods occurring singly and in chains approximately 3.0–4.0 microns×0.7–0.8 microns. Endospores were not initially observed. Subsequent analyses have demonstrated the presence of endospores.

Poor growth was demonstrated on nutrient broth. Nutrient agar growth yielded thin, transparent isolated colonies that are translucent in mass. The colonies are entire, smooth and glistening, slowly becoming opaque.

Biochemical Characterization

Maximum growth temperature=60° C.

Litmus milk—no change

Carbohydrate acid production:

| | Acid | Gas |
|---|---|---|
| Arabinose | + | – |
| Glucose | + | – |
| Lactose | No growth | |
| Mannitol | No growth | |
| Sucrose | + | – |
| Xylose | + | – |
| Growth at pH 6.0 | + | |
| Growth at pH 5.7 | + | |
| Citrate | – | |
| Propionate | – | |
| Azide glucose | + | |
| Egg-yolk reaction | w | |
| Starch hydrolysis | + | |
| Hippurate hydrolysis | – | |
| Gelatin hydrolysis | – (poor growth) | |
| Casein hydrolysis | – (poor growth) | |
| Tyrosine decomposition | – | |

-continued

| | Acid | Gas |
|---|---|---|
| Catalase | + | |
| Nitrate to nitrite | + | |
| Nitrate to $N_2$ | − | |
| Dihydroxyacetone | − | |
| Indole | − | |
| Voges-Proskauer | − | |
| Methylene blue | No growth | |
| NaCl | | |
| 5% | − | |
| 7% | − | |
| 10% | − | |

Culture PM-2 has been characterized by the American Type Culture Collection as a mixed culture of four apparently different colonies. Two of the colonies are biochemically and morphologically identical to PM-1. The other two colonies are biotypes of *Bacillus licheniformis.* They differ mainly in their aerotolerance. Their morphological and biochemical characteristics are as follows:

Colony 1

Morphological Characterization

Cells are Gram positive, motile rods, occurring singly, approximately 3.0×0.7 microns. Oval endospores were observed.

Good growth was demonstrated on nutrient broth. Nutrient agar growth yielded dull, dry, off white, flat matte, rhizoid spreading colonies. This strain demonstrated anaerobic growth but did not produce gas anaerobically from nitrate broth.

Biochemical Characterization

Maximum growth temperature=55° C.

Litmus milk—neutral, peptonized, reduced at 7–14 days.

Carbohydrate acid production:

| | Acid | Gas |
|---|---|---|
| Arabinose | + | − |
| Glucose | + | − |
| Lactose | w | − |
| Mannitol | w | − |
| Sucrose | + | − |
| Xylose | w | − |
| Growth at pH 6.0 | + | |
| Growth at pH 5.7 | + | |
| Growth in Na Azide | − | |
| Citrate | + | |
| Propionate | + | |
| Azide glucose | − | |
| Egg yolk reaction | − | |
| Starch hydrolysis | + | |
| Hippurate hydrolysis | − | |
| Gelatin hydrolysis | + | |
| Casein hydrolysis | + | |
| Tyrosine decomposition | − | |
| Catalase | + | |
| Nitrate to nitrite | + | |
| Nitrate to $N_2$ | − | |
| Dihydroxyacetone | + | |
| Indole | − | |
| Voges-Proskauer | + | |
| Methylene blue | | |
| reduction | + | |
| reoxidation | − | |
| NaCl | | |
| 5% | + | |
| 7% | + | |
| 10% | + | |

Colony 2

Morphological Characterization

Cells are Gram positive, motile rods, occurring singly and in chains, 3.0×0.8 microns. Oval subterminal and central endospores were observed.

Good growth was demonstrated on nutrient broth, nutrient agar growth yielded dull, dry, flat rhizoid colonies. Some colonies form mucoid and high convex blebs. This strain did not grow anaerobically.

Biochemical Characterization

Maximum growth temperature=55° C.

Litmus milk—alkaline, peptonized, reduced at 7 and 14 days.

Carbohydrate acid production:

| | Acid | Gas |
|---|---|---|
| Arabinose | + | − |
| Glucose | + | − |
| Lactose | − | − |
| Mannitol | + | − |
| Sucrose | + | − |
| Xylose | + | − |
| Growth at pH 6.0 | + | |
| Growth at pH 5.7 | + | |
| Citrate | + | |
| Propionate | weak | |
| Growth in Na Azide | − | |
| Azide glucose | − | |
| Egg-yolk reaction | − | |
| Starch hydrolysis | + | |
| Hippurate hydrolysis | − | |
| Gelatin hydrolysis | + | |
| Casein hydrolysis | + | |
| Tyrosine decomposition | − | |
| Catalase | + | |
| Nitrate to nitrite | + | |
| Nitrate to $N_2$ | − | |
| Dihydroxyacetone | + | |
| Indole | − | |
| Voges-Proskauer | + | |
| Methylene blue | | |
| reduction | + | |
| reoxidation | − | |
| NaCl | | |
| 5% | + | |
| 7% | + | |
| 10% | + | |

Culture PM-3 has been characterized by the American Type Culture Collection as *Bacillus licheniformis.* Its morphological and biochemical characteristics are set forth below:

Morphological Characterization

The cells are Gram positive, motile rods, 0.8×3–3.5 microns, occurring singly (rarely in chains) with rounded ends. Endospores are subterminal in location, and are oval to cylindrical in shape. Two colony types are present, one dull, dry, flat and irregular, and one entire smooth and glistening. The colonies are opaque and white in color.

Biochemical Characterization

Maximum growth temperature=55° C.

Litmus milk—+

Carbohydrate acid production:

| | Acid | Gas |
|---|---|---|
| Arabinose | + | − |
| Glucose | + | − |
| Lactose | − | − |
| Mannitol | + | − |
| Sucrose | + | − |

-continued

| | Acid | Gas |
|---|---|---|
| Xylose | + | – |
| Citrate | + | |
| Propionate | + | |
| Gelatin hydrolysis | + | |
| Tyrosine decomposition | – | |
| Growth on nutrient agar - pH 6.0 | + | |
| Dihydroxyacetone | + | |
| Methylene blue | | |
| reduction | + | |
| reoxidation | – | |
| Growth at pH 5.7 | + | |
| Egg yolk reaction | – | |
| Starch hydrolysis | + | |
| Hippurate hydrolysis | – | |
| Casein hydrolysis | + | |
| Catalase | + | |
| Nitrate to nitrite | + | |
| Nitrate to $N_2$ | – | |
| Indole | – | |
| Voges-Proskauer | + | |
| NaCl 5% | + | |
| NaCl 7% | + | |
| NaCl 10% | + | |

Culture PM-4 has been characterized by the American Type Culture Collection as *Bacillus circulans* (asporogenic strain). Its morphological snd biochemical characteristics are set forth below:

Morphological Characterization

The cells are Gram positive motile rods, 0.5×3.0 microns, occurring singly with rounded ends. Endospores were not observed. Colonies are smooth, glistening and translucent with central depressions appearing with age.

Biochemical Characterization

Maximum growth temperature=45° C.

Litmus milk—+

Carbohydrate acid production:

| | Acid | Gas |
|---|---|---|
| Arabinose | – | – |
| Glucose | + | – |
| Lactose | + | – |
| Mannitol | No growth | |
| Sucrose | + | – |
| Xylose | + | – |
| Citrate | – | |
| Egg yolk reaction | – | |
| Starch hydrolysis | – | |
| Propionate | – | |
| Gelatin hydrolysis | – | |
| Tyrosine decomposition | – | |
| Growth on nutrient agar - pH 6.0 | + | |
| Dihydroxyacetone | – | |
| Methylene blue | | |
| reduction | No growth | |
| reoxidation | No growth | |
| Growth at pH 5.7 | + | |
| Hippurate hydrolysis | – | |
| Casein hydrolysis | No growth | |
| Catalase | + | |
| Nitrate to nitrite | + | |
| Nitrate to $N_2$ | – | |
| Indole | – | |
| Voges-Proskauer | – | |
| NaCl 5% | – | |
| NaCl 7% | – | |
| NaCl 10% | – | |

Again, it must be emphasized that morphological or biochemical characteristics are not predictive or even suggestive of an organism's ability to denitrify tobacco materials under the fermentation conditions described herein. Instead, these morphological and biochemical characteristics are merely markers based on standard tests and broths used to characterize an organism and to distinguish it from other organisms. For example, none of PM-1, any of the four cultures of mixed culture PM-2, PM-3 or PM-4 displays the ability in such standard tests to metabolize nitrate to $N_2$. Yet, under the conditions of the process of this invention PM-1, mixed culture PM-2, PM-3 and PM-4 are useful in the start-up of anaerobic dissimilatory denitrification of tobacco materials.

Of course, it should also be understood that the start-up process of this invention is not limited solely to the above-described organisms. Rather, other thermophilic organisms that are characterized by the ability to reduce the level of nitrate and other nitrogen-containing compounds in tobacco materials via anaerobic, dissimilatory metabolism under the conditions described herein are useful in the process of the invention. Such organisms include both those belonging to the indigenous microflora of tobacco as well as organisms from a variety of other sources, e.g., soil. They also include mutations of those or other organisms or genetically engineered organisms that display a similar ability to reduce the levels of nitrate and other nitrogen-containing compounds in tobacco materials via anaerobic, dissimilatory metabolism under the conditions described herein. Such organisms may be isolated, selected and characterized in a similar manner to that described above.

According to one embodiment of the process of this invention, start-up of thermophilic microbial denitrification is effected as follows.

Generation and Storage of Seed Culture

The start-up seed culture used in the process of this invention comprises a 1 to 2 l. aliquot of a previously denitrified extracted tobacco extract product resulting from a thermophilic denitrification process, such as that described in U.S. patent application No. 307,602. Specifically, the denitrified tobacco extract product is collected from the main process fermentor of such a thermophilic denitrification process in 1 to 2 l. aliquots placed in sterilized, 2 l. screw-cap polypropylene storage jars and immediately refrigerated at a temperature below 4° C. and preferably between about 2° and 4° C. Alternatively, the denitrified tobacco extract may be frozen or lyophilized at a temperature sufficient to suspend microbial metabolic activity.

The denitrified tobacco extract product is preferably collected for storage as seed culture for the present process only when it results from runs of the thermophilic denitrification process during which:

the cycle time at the time of collection of the denitrified product corresponds to a dilution rate (flow rate/liquid volume) of at least 10%, preferably between about 15 and 20%, the run is not characterized by significantly high accumulations of either nitrate or nitrite, (nitrate not over 150 ppm and nitrite not over 350 ppm), the nitrate-nitrogen content of the feed tobacco extract being denitrified at the time of collection of the product is between about 2200 and 2800 ppm, the nitrite-nitrogen content of the feed tobacco extract being denitrified at the time of collection of the product is less than about 100 ppm, the organic acid content of the feed tobacco extract being denitrified at the time of collection of the product is about 0 or non-detectable ppm butyric acid, about 0 to 200 ppm propionic acid and about 10,000 to 12,000 ppm acetic acid.

In addition, the denitrified product itself, in order to serve as seed culture for the process of this invention preferably has the following characteristics:

nitrate-nitrogen content is about zero, nitrite-nitrogen content is less than or equal to about 100 ppm at time of collection (falling to zero afterwards), butyric acid content is about zero or non-detectable, cell concentration is greater than or equal to $1\times10^9$ to $4\times10^9$ cells/ml.

Start-Up Denitrification Using Seed Culture

Fed-Batch Start-Up

Start-up of the thermophilic denitrification process is effected using a small quantity of the stored, refrigerated seed. A 1 to 2 l. aliquot of stored seed culture is transferred into a sterile 14 l. fermentor vessel which is already on a fermentor mainframe and is hooked up to a sterile, preadjusted nitrogen-containing tobacco extract feed supply. Although the transfer of seed itself is not required to be carried out under sterilized conditions, it may be effected aseptically, in such a way that will not lead to the development of conflicting microbial processes. According to one embodiment of this invention, the nitrogen-containing tobacco extract is sterilized before it is contacted with the seed culture. Aseptic or sterilized conditions may, in some instances, serve to ensure consistency of the ultimate tobacco product. In a large-scale operation, sterilization is effected, for example, by maintaining the extract in a continuous sterilization system at about 140° C. for between about 5 and 10 minutes.

The nitrogen-containing tobacco extract feed may contain between about 1,200 and 3,000 or up to 7,000 ppm nitrate-nitrogen. The nitrate-nitrogen content of the tobacco extract is preferably increased, if necessary, prior to the optional sterilization, by the addition of an aqueous nitrate solution such as, for example, $KNO_3$, in an amount sufficient to raise it to between about 1200 and 3200 ppm, preferably 2,200 and 2,800 ppm. The organic acid content of the extract should be less than or equal to 30 ppm butyric acid, less than or equal to 30 ppm propionic acid and no more than between about 3,000 and 5,000 ppm acetic acid. In general, the pH of the tobacco extract is between about 5.2 and 8.0. The pH of the tobacco extract is between about 5.2 and 5.8, prior to sterilization, and between about 4.9 and 5.4 after sterilization. The pH of the tobacco extract is adjusted, if necessary, by the addition of an aqueous solution of a base, such as a CaOH, $NH_4OH$, NaOH or KOH solution, in an amount sufficient to raise it to between about 5.8 to 6.0. The soluble solids content of the tobacco extract is, for example, between about 5 and 15% with a total solids content between about 6 and 15%, preferably 6–10%.

Once removed from refrigeration, the seed culture is warmed or brought to a temperature of about 20 to 25° C. At this point, the nitrogen-containing tobacco extract is fed into the fermentor at the rate of 1 l/hr, or 10% vol reactor/hr. During this warming process, the contents of the fermentor are agitated by means of, for example, conventional bottom propellers or multiple impeller arrangements, of about 20–100 rpm. Subsequently, the contents of the fermentor are warmed or brought to a temperature between about 45° and 65° C., preferably between 45° and 55° C. Preferably, the seed culture to nitrogen-containing tobacco extract ratio is greater than 5% and is advantageously between 10 and 20% on a volume per volume basis.

During denitrification, the dissolved oxygen content of the fermentation charge should be low enough for anaerobic dissimilatory reduction of nitrate to nitrogen gas to occur. Typically, dissolved oxygen levels below 0.5 ppm are adequate. Optimally, however, levels as close to zero as possible may be more desirable in order to expedite dissimilatory denitrification. Although the initial oxygen content of the nitrogen-containing charge may be above zero, the content will rapidly be reduced by the microorganisms present in the seed culture, such that desirable low levels are achieved within the early part of the process. During operation of the process of this invention, near zero oxygen levels can be maintained by a similar mechanism. Sparging with an inert gas, such as nitrogen or helium, for 10 min at a flow rate equal to the volume to be deaerated is generally effective to reach about 0 ppm dissolved oxygen. However, it is an advantage of the process of this invention that sparging is not required and is generally not employed during operation of the process of this invention.

The feed rate for the nitrogen-containing extract is maintained at 1 l./hr (10% vol reactor/hr.) during the fill unless the nitrate-nitrogen level in the fermentor increases to greater than about 100 to 150 ppm and/or the nitrite-nitrogen level increases to greater than about 300 to 400 ppm. When such nitrate or nitrite levels are present, feeding is temporarily discontinued until the nitrate content falls to about zero and the nitrite content decreases to less than or equal to about 100 ppm. When these levels are present, feeding is resumed at 'l./hr (10% vol reactor/hr).

If the nitrate-nitrogen content in the fermentor remains at about zero and the nitrite-nitrogen content remains at less than or equal to 100 ppm, the feed rate of nitrogen-containing tobacco extract is increased to 0.15 vol/hr.

When the fill is complete and a final working volume of about 10 l. has been reached in the fermentor, the nitrate-nitrogen content is zero and the nitrite-nitrogen content is less than about 100 ppm, up to 90–100% of the denitrified volume may be pumped off rapidly into the next larger (500 l.) fermentor, where it functions as inoculum for a larger scale thermophilic denitrification process (10–20 hrs cycle time). The denitrified tobacco extract may, therefore, advantageously be used as inoculum for a large-scale thermophilic denitrification process. Feeding to the 14 l. fermentor is then resumed at a dilution rate of 10% or, typically, 15% as required by the system, until the final 10 l. working volume is attained.

Once that the start-up process of the invention has been initiated as described above, a dilution rate of 10% is attained within 2 to 3 cycles after start-up. The initial cycle of start-up occurs in a period of between about 6 to 12 hours, assuming a 50% heel, 10% feed rate and any delays in microbial activity due to the temperature shift between 2°–4° C. and 45°–65° C.

Each subsequent cycle should then require 50 to 75% of the previous-cycle time, until a 10% dilution rate cycle time of about 5 hours is reached, by the 3rd or 4th cycle.

As the 14 l. fermentor is supplied with feed, the nitrate-nitrogen, nitrite-nitrogen and pH levels are monitored at each 0.1 volume addition to ensure that the nitrate content is less than or equal to about 100 ppm and the nitrite content is less than or equal to about 250 ppm. If these levels are exceeded, feeding is discontinued, or the feed rate is decreased, until these levels are reached. The pH level at the end of a given run will be dependent upon characteristics of the incoming nitrogen-containing tobacco extract feed such as, for example, blend or compositional changes affecting buffering capacity and initial nitrate-nitrogen content—the higher the nitrate content, the higher the resultant pH.

After initiation of the start-up process of this invention, various factors should be apparent. If two successive cycles lacking any one of these factors occur, then the start-up culture is discarded and the start-up process is repeated. The following factors are advantageous to the process:

a dilution rate greater than or equal to 10% typically 15% with any change in rate from a previous cycle less than or equal to 50%, nitrate-nitrogen level during the fill below about 50 to 100 ppm and after completion of fill, less than about 50 to 100 ppm, nitrite-nitrogen level during the fill below about 350 ppm and after completion of fill, less than about 300 ppm, slight, if any, pH decrease during the initial period of the fill and subsequent increase during the last half of the fill (due to $NO_2$ removal) and ranging between about 7.5 and 8.5 at the end of the fill, no butyric acid production, no propionic acid production (although 2 to 300 ppm production acceptable in the case of successive, slow runs), cell concentration in fermentor greater than or equal to $1\times10^9$ cells/ml, preferably greater than or equal to $2\times10^9$ to $4\times10^9$ cells/ml, $N_2$ and/or $N_2O$ as major off-gas product Once the working volume has been replaced in the fermentor, the nitrate-nitrogen and nitrite-nitrogen content is measured. If the nitrate content is greater than zero, or is detectable, and the nitrite content is greater than 100 ppm, a post-filling finishing period may be required. If necessary, the finishing period should not exceed 25 to 50% of the fill time. In a 50% heel system, the fill time is between about 2.5 and 3.5 hrs and the finishing period should be complete within about ½ to 1½ hrs thereafter.

Straight-Batch Start-Up

As an alternative to the fed-batch start-up described above, the start-up process of the invention may initiate from a seed culture, which has been stored under refrigeration at a temperature below about 4° C., preferably between about 2° and 4° C., using a 1:10 batch process. Under this embodiment of the invention, a 1 to 2 l. aliquot of stored seed culture is transferred into a sterile, agitated 14 l. fermentor containing about 9 l. of a nitrogen-containing tobacco extract maintained at a temperature between about 45° and 65° C., preferably about 45° to 55° C. Although the transfer of seed need not be carried out under sterilized conditions, it should be effected aseptically, in the sense that it will not lead to the development of conflicting microbial processes. The characteristics of the denitrified tobacco extract present in the seed culture, as well as the nitrogen-containing feed, are the same as those described for the fed-batch start-up process.

Nitrate-nitrogen, nitrite-nitrogen and pH levels in the fermentor are monitored at 1 to 2 hour intervals until denitrification of the total volume has occurred. The time required for complete denitrification of the initial 10 l. volume ranges between about 15 and 30 hours.

Subsequently, 50% of the fermentor contents are pumped off rapidly into the next larger (500 l.) fermentor and additional nitrogen-containing tobacco extract is fed in at a rate of about 10% vol reactor/hr, until the full volume is replaced. During the fill, nitrate-nitrogen, nitrite-nitrogen and pH levels are monitored at each 10% volume addition.

When the fermentor has been refilled, the nitrate-nitrogen and nitrite-nitrogen content is measured. If denitrification is not completed by the end of the fill, a variable, post-filling finishing period may be required. This period should not exceed 10 to 30% of the fill time and is dependent upon factors such as actual duration of the fill time, nitrate-nitrogen content of the feed and the previous dilution rate of the system.

When the denitrified contents of the fermentor are to be used as inoculum for a larger-scale denitrification process, rather than as a future start-up seed culture itself, the following steps are employed to terminate the start-up process. The denitrified contents remaining in the fermentor after a portion of the volume has been pumped to a larger fermentor are pasteurized and held at 70° C., followed by sterilization to end microbial activity. The resulting product is then channeled to evaporators of the larger denitrification processing system.

In order to terminate the start-up process of the invention for a shutdown period of, for example, more than 12 hrs, with the contents of the fermentor to be used as a future start-up seed culture, the following steps are employed. At a nominal 10% fill rate, the nitrogen-containing tobacco extract feed is introduced until one-half of the working volume of the fermentor has been refilled—to a total volume of 75% capacity. The remaining half of the fill volume (25%) is introduced at a maximum feed rate of about 15% until the fermentor is full. At this point, heating to 45°–65° C. is discontinued and the fermentor is cooled to between about 2° to 4° C. During the shutdown period, the fermentor is maintained at between about 2° to 4° C., without agitation.

Start-up according to the process of this invention may, therefore, initiate from a refrigerated, full fermentor, prepared as described above, or a similarly prepared partially-full fermentor. Cooling of the fermentor is discontinued and agitation of the contents is resumed, as warming to 45°–65° C. is initiated. When the fermentor temperature reaches about 20° to 25° C., feeding with nitrogen-containing tobacco extract is resumed, at an initial rate of 10% vol/hr, until the vessel is full. When the nitrate-nitrogen and nitrite-nitrogen levels reach zero, the contents are discharged, and a normal fill cycle, such as that previously described, is resumed.

During this initial start-up cycle, nitrate-nitrogen, nitrite-nitrogen and pH levels in the fermentor are checked at each additional 10% of volume. As some microbial denitrification activity is initiated at about 25° C., the culture will consume incoming nitrate-nitrogen and nitrite-nitrogen during warm-up to 45°–65° C. In view of this occurrence, the feed rate of nitrogen-containing tobacco extract may have to be increased.

The start-up mixture should never contain any butyric acid. Normally, some propionic acid, 200 to 300 ppm, may accumulate during the cool-down or warm-up cycles, due to metabolic changes resulting from the progressive temperature shifts experienced by the culture, or because of alternative metabolisms expressed if nitrate and nitrite levels are depleted during cool-down and before the culture becomes metabolically inactive.

It should, of course, be understood that the optimum conditions for the start-up process of this invention will depend to some extent on the specific microorganisms present in the seed culture, as well as the particular characteristics of the nitrogen-containing tobacco extract feedstock. Although the time period required for the start-up process of this invention will vary according to the relative amounts of nitrate and culture, respective start-up conditions and the particular microorganisms involved, start-up should be effected within about 16 to 48 hours for a de novo start-up and about 3 to 12 hours for start-up from a full or partially-full seed culture-containing refrigerated fermentor.

If necessary at any time during a given start-up, the process may be temporarily halted by suspending the discharge of a finished volume of product or the refeeding of the saved heel. Accordingly, a concentrated, sterile, aqueous nitrate solution of, for example, $KNO_3$ is fed batch- or batch-added to the full or half full fermentor containing the denitrified product in an amount sufficient to raise the nitrate-nitrogen level in the product to between about 1000 and 2000 ppm.

The nitrate-nitrogen, nitrite-nitrogen and pH levels are then monitored at ½ to 1 hour intervals until denitrification is complete. The length of this denitrification cycle is dependent upon such factors as the prior nitrate-nitrogen removing capacity of the fermentor, the amount of nitrate-nitrogen added, the extent of microbial population and the characteristics of the fixed volume of the fermentor. Once the additional nitrate-nitrogen has been removed, the normal process operation may be resumed.

It is to be understood that the process of this invention may be employed to denitrify tobacco materials such as whole tobacco leaf, cut or chopped tobacco, reconstituted tobacco, tobacco stems, strips, fines or combinations thereof and aqueous extracts thereof. As used herein, references to tobacco and tobacco materials are to be understood to include all such forms of tobacco, such as green, cured or stored tobacco. Further it is to be understood that tobacco products, at least a portion of which contain tobacco material that has been denitrified in accordance with the process of the invention, exhibit a reduced level of nitrates and other nitrogen-containing compounds as compared to products prepared using wholly untreated tobacco material. Such tobacco products may include products consumed by smoking or by other means, e.g., chewing tobacco, snuff and the like. Moreover, when such tobacco products are consumed by combustion, they display reduced nitrogen oxide delivery, and perhaps reduced oxide delivery in general. Such latter smoking products include, for example, cigars, cigarettes, cigarellos and the like.

In accordance with the process of this invention, such tobacco materials may be contacted with the thermophilic microorganisms employed by this invention in any of the conventional ways. For example, in the case of aqueous tobacco extracts, continuous, batch and fed-batch processes are advantageously used. In the case of solid tobacco materials, conventional methods of fermentation, sweating and curing are useful.

In the practice of the present invention, the tobacco materials for contact with the seed culture of this invention are produced by employing conventional techniques. For example, tobacco materials may be contacted with an aqueous solution to extract the soluble components, including nitrate salts. The time of contact will depend on the water to tobacco ratio and the temperature of the aqueous solution. The aqueous extract produced by contact with the water solution is then separated from the insoluble fibrous tobacco residue, employing conventional solid-liquid separation techniques. For example, squeezing, centrifugation and filtration techniques may be employed. If necessary the separated tobacco extract may then be treated to adjust the soluble solids and/or nitrate content. Extracts containing up to about 7,000 ppm nitrate-nitrogen may be treated in accordance with this invention.

While a number of embodiments of this invention are presented hereinabove, it is apparent that the basic construction can be altered to provide other embodiments which utilize the process of this invention. Therefore, it will be appreciated that the scope of this invention is to be defined by the claims appended hereto rather than the specific embodiments set forth above.

I claim:

1. A process for the start-up of the denitrification of tobacco materials by thermophilic microorganisms comprising the steps of:

(a) contacting a seed culture which comprises denitrified tobacco materials comprising at least one thermophilic microorganism characterized by an anaerobic, dissimilatory, metabolic pathway that permits denitrification under anaerobic and high temperature conditions with nitrogen-containing tobacco materials which comprise primary or intermediate substrates in dissimilatory denitrification and;

(b) bringing the resulting mixture to a temperature which promotes anaerobic, dissimilatory denitrification, at temperatures above about 45° C., of the nitrogen-containing tobacco materials and the production of denitrified tobacco materials.

2. The process according to claim 1, further comprising the step of contacting a portion of the denitrified tobacco materials resulting from step (b) with nitrogen-containing tobacco materials which comprise primary or intermediate substrates in dissimilatory denitrification under anaerobic and high temperature conditions that promote the anaerobic, dissimilatory denitrification, at temperatures above about 45° C., of the nitrogen-containing tobacco materials.

3. The process according to claim 1, wherein said tobacco materials are selected from the group consisting of whole tobacco leaf, cut or chopped tobacco, reconstituted tobacco, tobacco stems, shreds, fines, combinations thereof and aqueous extracts thereof.

4. The process according to claim 1, wherein said denitrified tobacco materials are the product of a previous thermophilic denitrification process utilizing at least one thermophilic organism characterized by an anaerobic, dissimilatory, metabolic pathway that permits denitrification of tobacco materials under anaerobic and high temperature conditions that promote such denitrification.

5. The process according to claim 4, wherein said denitrified tobacco materials comprise an aqueous denitrified tobacco extract.

6. The process according to claim 4 wherein said denitrified tobacco materials have a nitrate-nitrogen content of about 0 ppm and a nitrite-nitrogen content of less than or equal to about 100 ppm.

7. The process according to claim 1, wherein said nitrogen-containing tobacco materials comprise an aqueous tobacco extract.

8. The process according to claim 7, wherein the pH of said tobacco extract is between about 5.2 and 8.0.

9. The process according to claim 8, wherein an aqueous solution of a base is first added to said tobacco extract in an amount sufficient to raise the pH of the extract to between about 5.8 and 6.0 and said extract is then contacted with said seed culture.

10. The process according to claim 7, wherein the nitrate-nitrogen content of said tobacco extract is up to about 7,000 ppm.

11. The process according to claim 10, wherein the nitrate-nitrogen content of said tobacco extract is between about 1,200 and 3,000 ppm.

12. The process according to claim 7, wherein said tobacco extract is first sterilized and then contacted with said seed culture.

13. The process according to claim 12 wherein prior to sterilization, an aqueous nitrate solution is added to the tobacco extract in an amount sufficient to increase the nitrate-nitrogen content of the extract to about 3200 ppm.

14. The process according to claim 12, wherein prior to sterilization, an aqueous nitrate solution is added to the tobacco extract in an amount sufficient to increase the nitrate-nitrogen content of the extract to between about 2,200 and 2,800 ppm.

15. The process according to claim 1, wherein the seed culture-tobacco materials mixture is brought to a temperature of between about 45° and 65° C.

16. The process according to claim 1, wherein the seed culture-tobacco materials mixture is brought to a temperature of between about 45° and 55° C.

17. The process according to claim 1, wherein said thermophilic organisms are selected from the group consisting of thermophilic organisms belonging to the usual microflora of tobacco materials, thermophilic organisms from other sources, genetically engineered thermophilic organisms, mutations of such organisms and combinations thereof, all such organisms being characterized by an anaerobic, dissimilatory, metabolic pathway for denitrification of tobacco materials under anaerobic and high temperature conditions that promote such metabolism.

18. The process according to claim 17, wherein said thermophilic organisms are selected from the group consisting of PM-1, PM-2, PM-3, PM-4, biotypes of *Bacillus circulans* and *Bacillus licheniformis*, mutations thereof, said biotypes and mutations being characterized by an anaerobic, dissimilatory, metabolic pathway for denitrification of tobacco materials under anaerobic and high temperature conditions that promote such metabolism, and combinations of any of the above.

19. The process according to claim 4, wherein said denitrified tobacco materials have a butyric acid content of about 0 ppm.

20. The process according to claim 4, wherein the cell concentration of thermophilic microorganisms present in said denitrified tobacco materials is between about $1\times10^9$ and $4\times10^9$ cells/ml.

21. The process according to claim 7, wherein the nitrite-nitrogen content of said tobacco extract is less than about 100 ppm.

22. The process according to claim 7, wherein said tobacco extract has a butyric acid content of about 0 ppm.

23. The process according to claim 1, wherein said nitrogen-containing tobacco materials comprise an aqueous tobacco extract having a total solids content of up to about 15% by weight.

* * * * *